United States Patent [19]

Mergens et al.

[11] 3,958,580

[45] May 25, 1976

[54] TREATMENT OF TOBACCO WITH ASCORBIC ACID

[75] Inventors: William Joseph Mergens, West Caldwell; Harold Leon Newmark, Maplewood, both of N.J.

[73] Assignee: Hoffmann-La Roche Inc., Nutley, N.J.

[22] Filed: Mar. 25, 1975

[21] Appl. No.: 561,816

Related U.S. Application Data

[63] Continuation-in-part of Ser. No. 442,990, Feb. 15, 1974, abandoned.

[52] U.S. Cl. ..... 131/17 R; 131/9; 131/266

[51] Int. Cl.[2] ..... A24B 15/02

[58] Field of Search..... 131/2, 9, 17 R, 140–144, 131/266

[56] References Cited

FOREIGN PATENTS OR APPLICATIONS

| | | |
|---|---|---|
| 932,561 | 12/1947 | France |
| 1,204,018 | 9/1970 | United Kingdom |

*Primary Examiner*—Robert W. Michell
*Assistant Examiner*—V. Millin
*Attorney, Agent, or Firm*—Samuel L. Welt; Bernard S. Leon; R. Hain Swope

[57] ABSTRACT

The amount of nitrogen dioxide in tobacco smoke is materially reduced by bringing the smoke into contact with uncombusted tobacco having dispersed therein an effective amount of a composition comprising a pharmaceutically acceptable salt of ascorbic acid or erthorbic acid or mixtures of such salts with their respective acids wherein the molar ratio of acid to salt does not exceed about 3:1.

8 Claims, No Drawings

TREATMENT OF TOBACCO WITH ASCORBIC ACID

RELATED APPLICATIONS

The subject application is a continuation in part of U.S. patent application Ser. No. 442,990 filed Feb. 15, 1974 now abandoned.

BACKGROUND OF THE INVENTION

The toxic effects of tobacco smoke, which had been suspect for many years, have now been firmly established by an overwhelming quantity of scientific evidence. Among the various harmful substances when have been shown to be present in tobacco smoke are the various oxides of nitrogen. Of the oxides of nitrogen normally present in tobacco smoke, nitrogen dioxide is the most toxic and most irritating. While the views of experts in the field are at a variance, it is estimated that as much as 50% of the nitrogen oxide content of tobacco smoke is nitrogen dioxide. The total nitrogen oxide content of tobacco smoke has been reported to range from about 145 ppm to about 1000 ppm.

In addition to the irritating and toxic properties of nitrogen dioxide per se in tobacco smoke, it has recently been shown that nitrogen dioxide and certain other oxides of nitrogen can form nitrosating intermediates which in turn can react with susceptible organic amines in the unburned tobacco to form nitrosamines. The phenomenon has been demonstrated by Johnson and Rhoades (J. Nat'l. Cancer Institute 48: 1845–1847, 1972) who reported finding up to 140 ng. of N-dimethyl-nitrosamine per cigarette. The nitrosamine content in the smoke from different types of tobacco can vary from practically none up to 140 ng./cigarette. The amount of nitrosamines present in the smoke of a given type of tobacco is influenced by a number of variables such as, for example, the amount of nitrogen-containing fertilizer used in growing the tobacco plants. N-dimethylnitrosamine is a highly toxic substance and is recognized as a potent carcinogen in animal experiments even at low levels of administration. It is therefore readily apparent that means to effectively reduce the nitrogen dioxide content of tobacco smoke would be of considerable benefit to those individuals who smoke tobacco in some form since reduction in the toxic, irritating nitrogen dioxide also results in a reduction in carcinogenic nitrosamines. Such a means is provided in accordance with the present invention whereby tobacco is treated with a pharmaceutically acceptable salt of ascorbic acid, or erthorbic acid of such salts with their respective acids wherein the molar ratio of acid to salt does not exceed about 3:1.

The effect of smoking on the ascorbic acid content of the human body as well as the benefit heavy smokers might possibly derive from ingestion of large amounts of ascorbic acid have been the subject of a number of reports in the literature. For example, Irwin Stone in his book entitled "The Healing Factor: Vitamin C Against Disease", Grosset & Dunlap, 1972, describes the substantial depletion of vitamin C in the body caused by smoking. The author recommends the ingestion of large amounts of ascorbic acid by heavy smokers for the prevention and treatment of what is termed "smoker's scurvy". This depletion of vitamin C in the body of heavy smokers has been substantiated by numerous others working in the field. These workers also have recommend that heavy smokers consume an abundance of vitamin C to prevent development of a deficiency thereof. These findings and recommendations are directed to the alleviation of one of the harmful effects of heavy smoking in the body, but do not effect the prevention of the formation of nitrosamines or oxides of nitrogen and their presence in the inhaled tobacco smoke.

French Pat. No. 932,560 discloses a device such as cigarette paper, straw-like structure, holder, mouthpiece or similar article with which the smoke comes in contact as it is being inhaled. The device, which may or may not be burned with tobacco, is of a fibrous nature and is either impregnated or covered with a "metabolite" which is stated as being a substance which can interact with normal cell metabolism such as, for example, vitamins including ascorbic acid, enzymes, coenzymes and the like. French Pat. No. 932,561 discloses treatment of tobacco with such "metabolites". The stated object in having such substances impregnated in or coated on such a device or the tobacco is that these metabolites are thereby mixed with the smoke in appreciable quantities thereby causing them to be inhaled with the smoke. The patents state that the presence of one or more of these metabolites in appreciable quantities in the smoke increases the tolerance of the user to "the toxic products (nicotine)" contained in the smoke. In operation, the metabolites contained in or coated on the device or the tobacco are stated as being progressively volatilized by the heat of combustion and are mixed with and consumed with the smoke.

The stated object of the methods disclosed and claimed in these Frenceh patents is to increase the tolerance of the smoker to the toxic products (nicotine) in the smoke. The teachings of these French patents, therefore, parallel those of Stone and others who have advocated the systemic administration of ascorbic acid to offset the deleterious effects of smoking in that all are concerned with attempting to minimize such effects after the smoke has been inhaled.

It has been found in accordance with the present invention that the amounts of at least one toxic substance, i.e. nitrogen dioxide, which is normally consumed with tobacco smoke can be sharply reduced before the smoke is inhaled.

SUMMARY OF THE INVENTION

The present invention relates to the substantial reduction of the amount of nitrogen dioxide inhaled with tobacco smoke by bringing the smoke into contact with uncombusted tobacco having dispersed therein an effective amount of a composition comprising one or more substances selected from the group consisting of a pharmaceutically acceptable salt of ascorbic acid or erythorbic acid or mixtures of such salts with their respective acids wherein the molar ratio of acid to salt does not exceed about 3:1. This material reduction in nitrogen dioxide content of the smoke also causes a reduction in the formation of harmful nitrosamines in the unconsumed tobacco thereby also effectively lowering the nitrosamine content of the smoke.

DETAILED DESCRIPTION OF THE INVENTION

The present invention is based on the discovery that the nitrogen dioxide content of tobacco smoke is markedly reduced as it is being drawn through uncombusted tobacco having dispersed therein an effective amount of one or more members of the group consisting of a pharmaceutically acceptable salt of ascorbic acid or erythorbic acid or mixtures of such salts with their respective acids wherein the molar ratio of acid to salt does not exceed about 3:1. Further, where tobacco is treated with one or more substances in accordance with the invention, the reduction in nitrogen dioxide content of the smoke in turn causes a reduction in the formation of nitrosamine which can be inhaled with the smoke. The formation of nitrosamines has been shown to occur as a result of reaction of nitrogen dioxide in the smoke with susceptible organic amines in the uncombusted tobacco. These effects of the method of the invention are most important as nitrogen dioxide recognized as being the most toxic and irritating of the nitrogen oxides normally present in tobacco smoke and at least one nitrosamine produced therefrom, i.e. N-dimethylnitrosamine, is a recognized carcinogen.

In accordance with the invention, tobacco or other material being smoked is treated with an effective amount of one or more substances selected from the group consisting of pharmaceutically acceptable salts of ascorbic acid or erythorbic acid or mixtures of such salts with their respective acids wherein the molar ratio of acid to salt does not exceed about 3:1. The amount of such substances to be utilized in accordance with the invention will vary over a wide range depending on such criteria as the "tar" content of the tobacco and, more particularly, on the organic nitrogen content thereof. Generally, treatment of tobacco or other smoking material with any amount of the substances named herein will cause some reduction of the nitrogen dioxide content of the smoke. As a practical matter, it has been found that an effective amount of such substances utilized to treat tobacco in the practice of the invention constitutes from about 0.1% by weight to about 10% by weight of the tobacco on a dry basis. In a more preferred embodiment, tobacco is treated with from about 1% by weight to about 4% by weight, on a dry basis, of one or more members of the group consisting of pharmaceutically acceptable salts of ascorbic acid, or erythorbic acid or mixtures of such salts with their respective acids wherein the molar ratio of acid to salt does not exceed about 3:1. As the average cigarette contains approximately one gram of tobacco, the above preferred percent range represents from of about 10 mg. to about 40 mg. of the substances of the invention per cigarette.

It is recognized that the tar and impurity content of tobacco smoke is materially increased as the cigarette, cigar, etc. is consumed. Therefore, it is to be understood that treatment of tobacco in accordance with the present invention may not have an appreciable effect on the last two or three inhalations of smoke. Thus, in order to achieve the full effect of the method of the invention, smoking of a cigarette, cigar, etc. containing treated tobacco should be discontinued while a reasonable amount remains unburned. It has been demonstrated by taste tests on human volunteers that the amount of pharmaceutically acceptable salts of ascorbic acid or erythorbic acid or the herein specified mixtures of such salts and their respective acids which is utilized to treat tobacco in accordance with the present invention has no detectable adverse effect on the "taste" of the smoke.

It is hypothesized that the substances utilized to treat tobacco in accordance with the present invention react with nitrogen dioxide to form nitric oxide and water. This so-called "trapping" of the nitrogen dioxide, in addition to removing a substantial amount thereof from the smoke taken into the lungs, acts to competitively inhibit the formation of carcinogenic nitrosamines by reaction of nitrogen dioxide with amines in the unburned tobacco. In one series of tests, it has been demonstrated that smoke from cigarettes prepared from tobacco treated in accordance with the present invention with a mixture of about 12 mg. of an equimolar mixture of the sodium salt of ascorbic acid and ascorbic acid per cigarette contains about one-third the nitrogen dioxide content of controls utilizing a fast puff test. It has also been demonstrated, using cigarettes containing approximately 25 mg. of such equimolar mixture per cigarette, that essentially none of said substances is taken into the body with the smoke.

The method of incorporating the substances of the present invention into the tobacco is not critical to the invention. Any method commonly recognized in the tobacco arts for incorporating additives into tobacco which results in a substantially uniform dispersion of the additive may be utilized so long as the conditions are not such as would adversely affect the active compounds used in the practice of this invention, i.e., excessive heat and prolonged exposure to moisture. The stability characteristics of ascorbic and erythorbic acids and their pharmaceutically acceptable salts as well as methods of preventing or retarding degradation thereof are well known in the arts of food and pharmaceutical formulating. It is preferred to add the active compounds of the present invention to tobacco by blending therewith in the dry state or by applying them as a solution or suspension in a suitable solvent such as water, ethanol, a polyhydric alcohol or the like.

In accordance with the present invention, pharmaceutically acceptable salts of ascorbic acid and/or erythorbic acid may be utilized individually or in combination with their respective acids wherein the molar ratio of acid to salt does not exceed about 3:1. As is evident from an examination of the data in the Tables in the examples which follow, pharmaceutically acceptable salts of ascorbic acid or erythorbic acid or the combinations thereof with their respective acids defined herein are highly efficacious in the method of the invention and are considered to be unexpectedly efficacious in comparison with pure acid utilized to treat tobacco in the manner of the invention.

In accordance with the present invention, wherein combinations of pharmaceutically acceptable salts of ascorbic acid and/or erythorbic acid and their respective acids are utilized, such combinations should not contain the acids in excess of a molar ratio of 3:1 with the salts. Preferred combinations comprise equimolar mixtures of ascorbic acid or erythorbic acid and their respective pharmaceutically acceptable salts.

Combinations of ascorbic acid or erythorbic acid with their respective pharmaceutically acceptable salts in a molar ratio of about 3:1 acid to salt have, as a 0.1 normal aqueous solution, a pH of about 4. Since increasing the ratio of salt in such combinations will raise the pH, a pH of about 4 or above for a 0.1 N aqueous solution of a given combination of ascorbic acid or erythorbic acid and their respective pharmaceutically acceptable salts is considered to be an indication of the efficacy thereof in the practice of the invention notwithstanding the fact that tobacco treated in accordance with the invention is in a dry state.

The following examples are given to further illustrate the invention.

EXAMPLE 1

Tobacco removed from commercially prepared cigarettes was treated in the following manner. An aqueous solution containing 75 mg/ml. of an equimolar mixture of ascorbic acid and sodium ascorbate was sprayed onto the tobacco. The amount of said solution applied was approximately 15% by weight based on the dry weight of the tobacco. The tobacco was then dried utilizing a stream of nitrogen gas until the weight gain of the treated tobacco was equal to the amount of the ascorbic acid/sodium ascorbate mixture deposited i.e. all the applied water has been removed. The tobacco thus-treated was then weighed to give the same proportionate fill as that previously recorded for the commercial cigarettes and formed into cigarettes utilizing a B & W Cigarette Roller manufactured by the Brown and Williamson Tobacco Corp. Cigarettes prepared in this manner were approximately 7 cm in length and contained 0.83 grams of tobacco per cigarette.

A total of 15 grams of an equimolar mixture of ascorbic acid and sodium ascorbate was pulverized to a fine powder utilizing a mortar and pestle. A sufficient quantity of this mixture was added to the tobacco taken from commercially prepared cigarettes to represent 3.75% by weight thereof. The ascorbic acid mixture was added in small portions while rotating the mixing vessel thereby assuring homogeneous distribution. Cigarettes were prepared from this tobacco as described above.

As controls, cigarettes were prepared from tobacco removed from commercial cigarettes which had been sprayed with distilled water and dried utilizing nitrogen gas until the initial weight of the tobacco was achieved.

EXAMPLE 2

Cigarettes were prepared in accordance with the method of Example 1 utilizing a sufficient amount of an aqueous solution of an equimolar mixture of ascorbic acid and sodium ascorbate so that each cigarette contained a total of 25 mg. The cigarettes of the mixture were smoked in an apparatus similar to that described by Millar et al., Cancer Research, Vol. 28, pages 968–κ971 (1968). The collected tars from treated and untreated control cigarettes were individually analyzed for ascorbic acid content. The analytical procedure utilized was that outlined by Roe et al. "methods of vitamin assay" third edition, pages 318 ff., Interscience (1966). The results of this analysis are given in the following table.

Table 1

| Sample | μg. Ascorbic Acid in Tars from 20 Cigarettes |
|---|---|
| Untreated cigarettes | 20 |
| Untreated cigarettes + 100 μg. added for analysis purposes | 117 |
| Treated cigarettes | 27 |

The results of the foregoing analysis indicate that a maximum of 1 part in 10,000 of the ascorbic acid content of the tobacco was carried over into the tar fraction of the smoke. The value of 27 micrograms per 20 cigarettes lies near the limit of detection for ascorbic acid under the analytical conditions utilized. It is therefore a reasonable assumption that more sensitive methods of testing may reveal that the value of ascorbic acid in the tar may be even lower than shown in the above table. The results given in the above Table can be interpreted as indicating that essentially no ascorbic acid is transferred from the treated tobacco to the tar during the smoking process.

EXAMPLE 3

Whatmann No. 1 filter paper was cut into discs having a diameter of 13 mm. These discs were treated with an aqueous solution of equimolar concentrations of ascorbic acid and sodium ascorbate in accordance with the procedure of Example 1 so that the concentration thereof in each disc was 0.6 mg. of the combination. Discs treated with distilled water served as controls. Such discs were individually mounted in a Swinny adapter which was fitted onto a 5 cc. gas tight syringe. A 2 cc. sample of a gaseous mixture containing 10 parts per million nitrogen dioxide was passed twice through each paper disc. The nitrogen dioxide content of this sample was analyzed by the method of Greiss-Saltzman, "Methods of Air Sampling and Analysis" American Public Health Assoc., page 333, (1972). The results of this experiment show that the nitrogen dioxide content of the sample passed through the untreated controlled disc was approximately equal to that passed through the syringe with no disc at all and that the content of the sample passed through the treated disc was, on the average, approximately 10% of the original content of the sample.

EXAMPLE 4

Cigarettes treated with 12 mg/cigarette of equimolar mixtures of ascorbic acid/sodium ascorbate and erythorbic acid/sodium erythorbate in accordance with the aqueous solution method of Example 1 were smoked in the following manner. A 50 ml. syringe was utilized to draw smoke from a cigarette attached to an adaptor. The smoke was immediately deposited in a collection vessel containing Greiss-Saltzman reagent. The smoke of treated and untreated (control) cigarettes was then analyzed for nitrogen dioxide content. A standardized fast draw and slow draw technique was utilized to smoke the cigarettes. The definitions of these techniques are set forth in Table I.

TABLE I

| Parameter | Fast Draw | Slow Draw |
|---|---|---|
| Puff Volume | 35 cc | 35 cc |
| Puff Duration | 2 sec | 6 sec |
| Puff frequency | 1/min | 1/min |
| Average butt length | 23 mm | 23 mm |

The results of the tests are set forth in Table II wherein the amount of nitrogen dioxide in the smoke is given as a percent of control.

TABLE II

| | Slow Draw | Fast Draw |
|---|---|---|
| Ascorbic Acid & Sodium Ascorbate | 38 | 58 |
| Erythorbic Acid & Sodium Erythorbate | 35 | 52 |

EXAMPLE 5

Cigarettes prepared in accordance with Example 1 utilizing a sufficient amount of a powder mixture of equimolar amounts of ascorbic acid and sodium ascorbate so that each cigarette contained 35 mg. of the mixture were smoked on an apparatus described by Millar et al. in Cancer Research, Vol. 28, pages 968–971, May, 1968. The tars from treated cigarettes and controls were analyzed for N-nitrosamine content according to the method of Rhoades et al. described in the Journal of the National Cancer Institute, Vol. 48, pages 1841–1843 and 1845–1847 (1972). The results of this test show that the content of dimethyl-N-nitrosamine of the cigarette smoke in controls was reduced by approximately 70% in the treated cigarettes.

EXAMPLE 6

The following experiment was conducted to determine the relative effectiveness of sodium ascorbate and three molar ratios thereof with ascorbic acid, i.e. 1:3, 1:1 and 3:1 in comparison with ascorbic acid alone and distilled water (control).

Sealed 25 cc vials containing distilled water (controls) and solutions containing 50 mg of sodium ascorbate, ascorbic acid and combinations of 1:3, 1:1 and 3:1 molar ratios thereof, respectively, were exposed to nitrogen dioxide gas which was injected via a gas tight syringe. The solutions were exposed to fixed quantities of nitrogen dioxide gas, i.e. 15, 39 or 90 mcg for 5 seconds. Five seconds was selected for the residence time of nitrogen dioxide in the vial since it represents average normal puff duration in smoking (2–6 seconds). The quantities of nitrogen dioxide utilized were selected to represent an approximation of the range of $NO_2$ formed in the smoking of one cigarette (a good average value being approximately 75 mcg per cigarette).

After a 5 second exposure, the nitrogen dioxide was removed from the vial and injected into a second vial for analysis by the method of Greiss-Saltzman, "Methods of Air Sampling and Analysis" American Public Health Association., page 333, (1972). The results of this experiment are reported in Table I. In each instance, the distilled water controls absorbed some nitrogen dioxide. The values given for the various concentrations of ascorbic acid (AA) sodium ascorbate (SA) and the various molar ratios thereof tested are corrected by subtracting therefrom the value for control.

TABLE I

| Composition in Solution | Amount of $NO_2$ Introduced/ Percent Destroyed | | |
|---|---|---|---|
| | 15 mcg | 39 mcg | 90 mcg |
| 0.25 ml | | | |
| — | 8 | 18 | 14 |
| AA | 13 | 20 | 0 |
| AA+SA (3:1 molar ratio) | 31 | 55 | 19 |
| AA+SA (1:1) molar ratio) | 34 | 38 | 44 |
| AA+SA (1:3 molar ratio) | 43 | 48 | 41 |
| SA | 48 | 57 | 42 |
| 0.5 ml | | | |
| — | 8 | 16 | 16 |
| AA | 13 | 10 | 3 |
| AA+SA (3:1 molar ratio) | 26 | 39 | 32 |
| AA+SA (1:1 molar ratio) | 70 | 53 | 54 |
| AA+SA (1:3 molar ratio) | 60 | 42 | 47 |
| SA | 40 | 18 | 51 |
| 1.0 ml | | | |
| — | 6 | 17 | 14 |
| AA | 16 | 11 | 5 |
| AA+SA (3:1 molar ratio) | 22 | 31 | 37 |
| AA+SA (1:1 molar ratio) | 39 | 44 | 58 |
| AA+SA (1:3 molar ratio) | 56 | 64 | 25 |
| SA | 55 | 49 | 54 |

TABLE I-continued

| Composition in Solution | Amount of $NO_2$ Introduced/ Percent Destroyed | | |
|---|---|---|---|
| | 15 mcg | 39 mcg | 90 mcg |
| 2.0 ml | | | |
| — | 8 | 15 | 18 |
| AA | 22 | 15 | 11 |
| AA+SA (3:1 molar ratio) | 44 | 24 | 41 |
| AA+SA (1:1 molar ratio) | 71 | 37 | 63 |
| AA+SA (1:3 molar ratio) | 86 | 36 | 37 |
| SA | 58 | 45 | 55 |

A similar experiment conducted with 39mcg of nitrogen dioxide and 1.0 ml of solution with sodium erythorbate (SE) and erythorbic acid (EA) gave the following results.

| Composition of Solution | Percent $NO_2$ Removed |
|---|---|
| EA | 0 |
| EA+SE (3:1 molar ratio) | 44 |
| EA+SE (1:1 molar ratio) | 58 |
| EA+SE (1:3 molar ratio) | 37 |
| SE | 54 |

EXAMPLE 7

The following experiment was conducted to demonstrate the effect of an equimolar mixture of ascorbic acid and sodium ascorbate in a cigarette filter or other trap on the dimethyl-N-nitrosamine content of smoke passing through;

A solution of 100 ug of dimethyl-N-nitrosamine (DMN) in 0.10 ml of dichloromethane was introduced into a U-tube by syringe and the solvent carefully evaporated. The U-tube was connected through a second tube containing a filter to a cold trap containing dichloromethane, an excellent solvent for DMN. The filter consisted of glass wool containing 50 mg of an equimolar mixture of very finely divided ascorbic acid and sodium ascorbate. The portion of the U-tube containing the DMN was then immersed in a constant temperature bath at 60°C. to aid volatilization of the DMN and also to resemble the heated smoke passing through a cigarette. A total of 200 cc of air was drawn through the system by vacuum pull utilizing a 50 cc syringe. After 200 cc of air were drawn through the system. The contents of the trap were quantitatively transferred to a volumetric flask and read spectrophotometrically in 5 cm cells at 354 nm. The percent DMN passing through the filter is shown in Table II. As controls, similar tests were conducted utilizing identical filters containing no ascorbic acid/sodium ascrobate identified as "untreated" and tubes containing no filter whatsoever.

TABLE II

| Type of Filter | Number of Samples | Range of Results (%) | Average (%) |
|---|---|---|---|
| None | 2 | 98–100 | 99 |
| Untreated | 4 | 92–103 | 98 |
| Treated | 8 | 92–108 | 100* |

*The same samples analyzed by gas liquid chromatography gave an average of 97%.

The results of this experiment demonstrate that, once dimethyl-N-nitrosamine is formed, the mixture of ascorbic acid and sodium ascorbate tested has no capability to remove it from smoke.

We claim:

1. A method for the reduction of nitrogen dioxide content in tobacco smoke which comprises passing said smoke through uncombusted tobacco having dispersed therein an effective amount of a substance selected from the group consisting of a pharmaceutically acceptable salt of ascorbic acid or erythorbic acid, or mixtures of said salts with their respective acids wherein the molar ratio of acid to salt does not exceed about 3:1.

2. The method in accordance with claim 1 wherein the smoke is passed through tobacco containing an effective amount of an equimolar mixture of ascorbic acid and a pharmaceutically acceptable inorganic salt thereof.

3. The method in accordance with claim 2 wherein said salt is the sodium salt.

4. The method in accordance with claim 1 wherein the smoke is passed through tobacco containing an effective amount of an equimolar mixture of erythorbic acid and a pharmaceutically acceptable inorganic salt thereof.

5. The method in accordance with claim 4 wherein said salt of the erythorbic acid is the sodium salt.

6. The method in accordance with claim 1 wherein said substance is sodium ascorbate.

7. The method in accordance with claim 1 wherein said substance is sodium erythorbate.

8. The method in accordance with claim 1 wherein said tobacco contains a sufficient amount of said substance to constitute from about 0.1% by weight to about 10% by weight of said tobacco.

* * * * *